US006774579B2

(12) United States Patent
Abe

(10) Patent No.: US 6,774,579 B2
(45) Date of Patent: Aug. 10, 2004

(54) ELECTRIC DISCHARGE LAMP AND ELECTRIC DISCHARGE LAMP DRIVE APPARATUS

(75) Inventor: Eiji Abe, Imabari (JP)

(73) Assignee: Harison Toshiba Lighting Corp., Ehime (JP)

( * ) Notice: Subject to any disclaimer, the term of this patent is extended or adjusted under 35 U.S.C. 154(b) by 0 days.

(21) Appl. No.: 10/380,202

(22) PCT Filed: Mar. 20, 2002

(86) PCT No.: PCT/JP02/02706

§ 371 (c)(1),
(2), (4) Date: Mar. 13, 2003

(87) PCT Pub. No.: WO02/078406

PCT Pub. Date: Oct. 3, 2002

(65) Prior Publication Data

US 2004/0100209 A1 May 27, 2004

(30) Foreign Application Priority Data

Mar. 23, 2001 (JP) ..... 2001-84033

(51) Int. Cl.[7] ..... H05B 37/00

(52) U.S. Cl. ..... 315/219; 315/276; 315/209 CD; 315/224

(58) Field of Search ..... 315/219, 276, 315/291, 224, 225, 308, 209 CD, 209 R, DIG. 7

(56) References Cited

U.S. PATENT DOCUMENTS 3,604,978 A * 9/1971 Van Houten et al. . 315/209 CD
5,623,187 A * 4/1997 Caldeira et al. ..... 315/224
6,222,325 B1 * 4/2001 Wuidart et al. ..... 315/219

OTHER PUBLICATIONS

JP 2001–35676A, Harison Toshiba Lighting Corp., Feb. 9, 2001.
JP 11–214184A, Harison Denki Kabushiki Kaisha, Aug. 6, 1999.
JP 2002–75682 A, Harison Toshiba Lighting Corp., Mar. 15, 2002.

* cited by examiner

*Primary Examiner*—Wilson Lee
(74) *Attorney, Agent, or Firm*—Banner & Witcoff, Ltd.

(57) ABSTRACT

A lighting control signal generating circuit 10 controls the output pulse of a drive signal circuit 11 by the output signal. The output pulses of the drive signal circuit 11 include a first and a second pulse drive signal 11*a*, 11*b*, each of which has a phase inverted to each other. These first and second pulse drive signals 11*a*, 11*b* are controlled the repetition frequency by the output signal of said light control signal generating circuit 10. Further, the drive signal circuit 11 generates a third pulse drive signal 11*c* which is so controlled as to be turned ON and OFF in accordance with the output signal of the light control signal generating circuit 10. The first and second pulse drive signal 11*a*, 11*b* supplied by the drive signal circuit 11 control the first and the second switching device S1, S2 by turning them ON and OFF alternately. A pulse transformer 12 is provided with a primary coil L1 and a secondary coil L2. The direction of the current flowing in the primary coil L1 is switched and a boosted pulse voltage is generated in the secondary coil L2. A flicker preventing circuit 14 is connected with the primary coil L1 of the pulse transformer 12 in parallel. This flicker preventing circuit 14 is composed of a series connection circuit of a third switching device S3 and an element R having a resistance component. The third switching device S3 is turned ON and OFF in accordance with the third drive signal 11*c* supplied by the drive signal circuit 10. An outer electrode fluorescent lamp is connected with the secondary coil L2 of the pulse transformer 12.

21 Claims, 7 Drawing Sheets

ELECTRIC DISCHARGE LAMP AND ELECTRIC DISCHARGE LAMP DRIVE APPARATUS

This is a U.S. National Phase Application Under 35 USC 371 and applicants herewith claim the benefit of priority of PCT/JP02/02706 filed on Mar. 20, 2002, which was published Under PCT Article 21(2) in Japanese, and of Application No. 2001-84033 filed in Japan on Mar. 23, 2001.

FIELD OF INVENTION

The present invention relates to a discharge lamp device and especially to a discharge lamp drive device suited for backlight sources for liquid crystal display units.

BACKGROUND TECHNOLOGY

Conventional liquid crystal display units used for electronic devices such as personal computers, car navigation systems use cold cathode fluorescent lamps as backlight sources for liquid crystal units. By the way, the cold cathode fluorescent lamps for this backlight source are required to have a high performance such as high brightness, low power consumption, small size, or long life according with the spread and the progress of electronic devices such as personal computers for high performance. For such demands, an outer electrode type fluorescent lamp is attracting attention. As one configuration of this outer electrode type fluorescent lamp, a lamp with a following structure is known. That is, the fluorescent lamp is composed of a glass tube in which a rare gas mainly composed of xenon (discharge medium) is enclosed airtight, on the inner surface of which a phosphor film is formed. An outer electrode, which is wound spirally around the glass tube along almost, the entire length, and an inner electrode is provided at least at one end of the glass tube.

Such outer electrode type fluorescent lamp is, generally, driven and lighted by a high frequency pulse source. The high frequency pulse source is composed of a signal drive circuit, which generates high frequency pulse signal, and an inverter circuit including a pulse transformer to which the output pulse signal of the signal drive circuit is supplied.

Now, in a liquid crystal display unit, a function is required that the luminance of the display panel is adjusted in accordance with its use circumstances. That is, in liquid crystal display unit, more effective image display is possible by properly selecting brightness etc. in accordance with an image displayed or a place where the display unit is operated. Adjusting the luminance of backlight source, that is, by a light control performs such luminance adjustment on the liquid crystal display screen. The light control of the outer electrode type fluorescent lamp described above is performed by varying the numbers of the output pulse per unit time put out of the high frequency pulse source. That is, the output pulse from the high frequency pulse source supplies a high frequency pulse of 200 pulses per second, for example, to the outer electrode type fluorescent lamp. Decreasing the number of the pulses, however, the luminance of the fluorescent lamp can be decreased. Now assuming that, the luminance of a fluorescent lamp is maximum when the high frequency pulse of 200 pulses per sec. is supplied to the outer electrode type fluorescent lamp, the light control ratio will be 50% if the number of pulses per sec. is decreased to, for example, 100 pulses per sec However, in the light control of conventional outer electrode type fluorescent lamp, if the lighting control ratio is decreased to 1 to 5%, there was a problem that the light emission of the lamp becomes unstable, and so called a flickering might have occurred.

Taking such problems into consideration makes the present invention, and it is an object of the present invention to supply a discharge lamp device, which is capable of preventing the flickering at the low light control ratio, and to enable a stable light emission in a wide range of the light control.

DISCLOSURE OF THE INVENTION

The discharge lamp device according to the present invention includes a light control signal generating circuit, a drive signal circuit for generating a first, a second and a third pulse drive signals. A pulse repetition frequency of the first and the second pulse drive signals are controlled by an output signal of the light control signal generating circuit. The phases of the first and the second pulse drive signals are inverted to each other. The third pulse drive signal alternately turns on and off in accordance with the output signal of the light control signal generating circuit. The discharge lamp device according to the present invention further includes a first and a second switching devices each of which is alternately controlled open and close by said first and the second pulse drive signals supplied from the drive signal circuit, a pulse transformer having a primary coil and a secondary coil, in which a direction of a current flowing in the primary coil is switched by the first and second switching device and in which an up converted pulse voltage is generated in the secondary coil, and a flicker preventing circuit connected in parallel with the primary coil of said pulse transformer. The flicker preventing circuit is composed of a series connected circuit of a third switching device, which is made on and off in according with the third drive signal supplied from the drive signal circuit and an element having a resistance component. The discharge lamp device according to the present invention further includes an outer electrode fluorescent lamp connected with the secondary coil of the pulse transformer.

Further, in the discharge lamp device according to the present invention, the first and second switching devices are connected between the power source and the ground in series. The primary coil of said pulse transformer is connected with the connection point of said first and second switching devices and a capacitor is connected between the power source and the ground.

Further, in the discharge lamp device according to the present invention, the third drive signal supplied from the drive signal circuit turns the third switching device ON when the lighting control ratio designated by the output signal of the light control signal generating circuit is equal to or lower than a prescribed value, and turns the third switching device OFF when the lighting control ratio designated by the output signal of the light control signal generating circuit is equal to or higher than a prescribed value.

Further, in the discharge lamp device according to the present invention, the prescribed value of the light control ratio is about 20%.

Further, in the discharge lamp device according to the present invention, at least one of the first and second switching device is connected with a uni-directional element which allows an electric current to flow in one direction.

Further, in the discharge lamp device according to the present invention, the outer electrode fluorescent lamp is composed of a glass tube on the inner face of which a phosphor film is formed and a rare gas mainly composed of xenon is enclosed airtight therein, an inner electrode which is provided inside one end of the glass tube and from which a lead terminal is lead out of the glass tube, an outer electrode which is wound spirally around the outer surface of the glass tube along almost the entire length of the tube at a prescribed pitch.

Further, in the discharge lamp device according to the present invention, plurality of sets of the first and second switching devices, the pulse transformer, the flicker preventing circuit including the third switching device, and the outer electrode type fluorescent lamp are provided. The first and the second pulse-driving signal of the drive signal circuit are supplied in parallel to the first and said second switching devices of each of the plurality of sets. The third pulse-driving signal of the driving signal circuit is supplied in parallel to the third switching device of each of the plurality of sets.

The discharge lamp drive device according to the present invention includes a light control signal generating circuit, a drive signal circuit for generating a first, a second and a third pulse drive signals. A pulse repetition frequency of the first and the second pulse drive signals are controlled by an output signal of the light control signal generating circuit. The phases of the first and the second pulse drive signals are inverted to each other. The third pulse drive signal alternately turns on and off in accordance with the output signal of the light control signal generating circuit. The discharge lamp device according to the present invention further includes a first and a second switching devices each of which is alternately controlled open and close by said first and the second pulse drive signals supplied from the drive signal circuit, a pulse transformer having a primary coil and a secondary coil, in which a direction of a current flowing in the primary coil is switched by the first and second switching device and in which an up converted pulse voltage is generated in the secondary coil, and a flicker preventing circuit connected in parallel with the primary coil of said pulse transformer. The flicker preventing circuit is composed of a series connected circuit of a third switching device, which is made on and off in according with the third drive signal supplied from the drive signal circuit and an element having a resistance component.

Further, in the discharge lamp drive device of the invention, the first and second switching devices are connected between the power source and the ground in series. The primary coil of said pulse transformer is connected with the connection point of said first and second switching devices and a capacitor is connected between the power source and the ground.

Further, in the discharge lamp drive device of the invention, the third drive signal supplied from the drive signal circuit turns the third switching device ON when the lighting control ratio designated by the output signal of the light control signal generating circuit is equal to or lower than a prescribed value, and turns the third switching device OFF when the lighting control ratio designated by the output signal of the light control signal generating circuit is equal to or higher than a prescribed value.

Further, in the discharge lamp drive device of the invention, the predetermined value of the lighting control ratio is about 20%.

Further, in the discharge lamp drive device of the invention, at least one of the first and second switching device is connected with a uni-directional element which allows an electric current to flow in one direction.

Further, in the discharge lamp drive device of the invention, a plurality sets of the first and second switching devices, the pulse transformer, the flicker preventing circuit including the third switching device, and the outer electrode type fluorescent lamp are provided. The first and the second pulse-driving signal of the drive signal circuit are supplied in parallel to the first and said second switching devices of each of the plurality of sets. The third pulse-driving signal of the driving signal circuit is supplied in parallel to the third switching device of each of the plurality of sets.

Further, in the discharge lamp device or the discharge lamp drive device of the invention, the uni-directional current device is at least one selected from the group of a diode, a transistor, a MOSFET, and a photo coupler.

Further, in the discharge lamp device or the discharge lamp drive device of the invention, by inserting a device having a resistance component together with the uni-directional device such as a rectifier, which allows an electric current to flow in one direction, the stabile lighting can be more improved. The resistance component is, for example, a resistance device of from 0.05 to 10Ω, or an inductor device of such resistance.

With the invention described above, the flicker does not occur and a stable lighting of high luminance can be maintained and enables low power consumption in the wide range of lighting control ratio. Moreover, the light control can be performed easily with a precise control of luminance because the flicker is prevented.

DETAILED DESCRIPTION OF THE INVENTION

The embodiments according to the present invention will be explained below referring to the figures.

Figure 1:
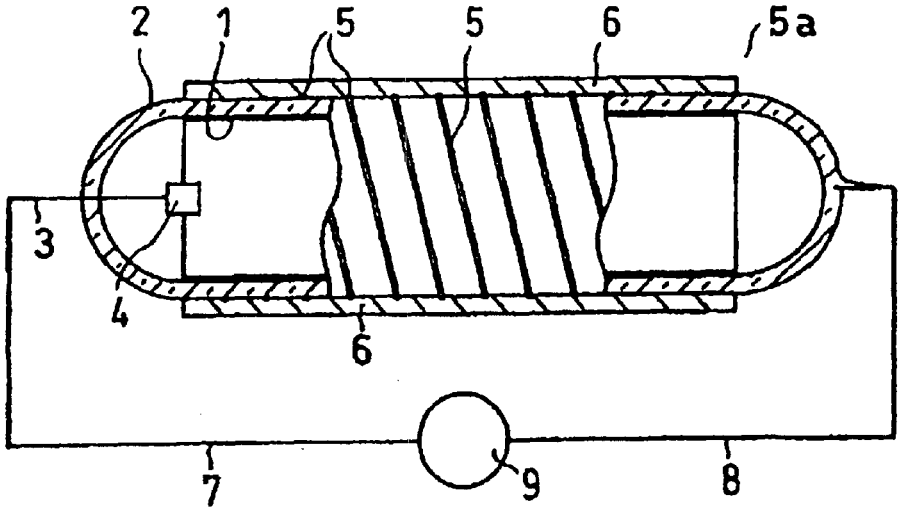
FIG. 1 is a cross section showing an example of an outer electrode type fluorescent lamp used in an embodiment of the present invention.

FIG. 1 is a cross section showing an example of an outer electrode type fluorescent lamp used in an embodiment according to the present invention. The outer electrode type fluorescent lamp is composed of a glass tube 2 on an inner wall of which a phosphor film 1 is formed. A rare gas, which is a discharge medium and is composed mainly of xenon gas, is enclosed airtight inside the glass tube 2. An inner electrode 4 is mounted at one end of the glass tube 2. A lead terminal 3 of the inner electrode 4 is lead out of the glass tube 2. An outer electrode 5 is spirally wound around the outer surface of the glass tube 2 along almost its entire length at a prescribed pitch.

Figure 2:
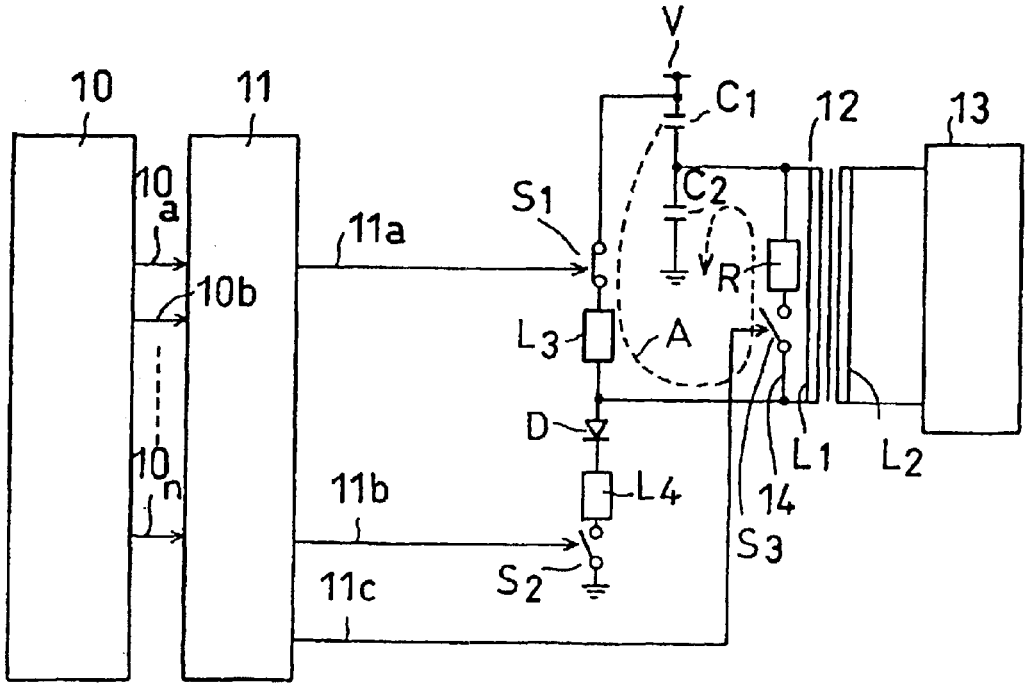
FIG. 2 is a block diagram showing a discharge lamp drive device and its operation according to the embodiment of the present invention.
Figure 3:
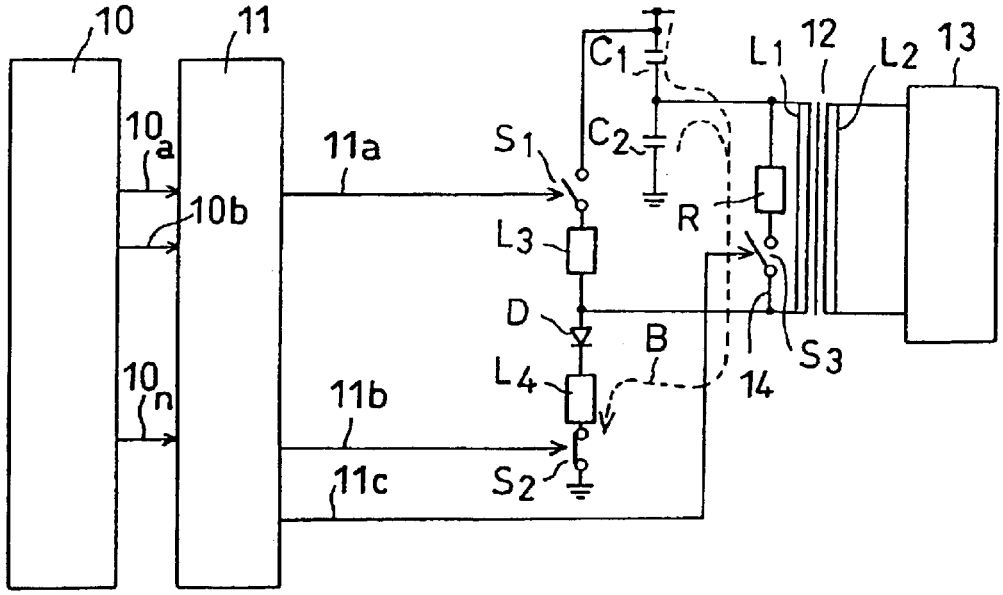
FIG. 3 is also a block diagram showing an embodiment of discharge lamp drive device together with the operation according to the embodiment of the present invention.

FIG. 2 and FIG. 3 are the block diagrams showing embodiments of the discharge lamp drive device with its operation according to the present invention.

As shown in the figures, the light control signal generating circuit 10 supplies its output signals 10*a*, 10*b*, . . . , 10*n* to a drive signal generating circuit 11. The drive signal generating circuit 11 supplies a first and a second switching device S1, S2 with a first pulse drive signals 11*a* and a second pulse drive signals 11*b*. Specifically, the drive signal circuit includes microcomputers and oscillators, for example, and generates required output pulses. The switching devices S1 and S2 are made ON and OFF by the pulse drive signals 11*a*, 11*b*. The switching devices S1 and S2 supply a pulse voltage between terminals of a primary coil L1 of a pulse transformer 12. In detail, the first switching device S1 is connected between a power source V and one of the terminals of the primary coil L1 of the pulse transformer 12 via an series connected inductance device L3. The second switching device S2 is connected between one of the terminals of the primary coil L1 and the ground via a series connection of a device D and an inductance device L4. The device D is such an element as a diode, for example, for allowing an electric current to flow in one direction. Capacitor C1 and C2 are connected in series between the power source V and the ground. At the connecting point of the capacitor C2 and C2, the other terminal of the primary coil L1 of the pulse transformer 12 is connected. The pulse transformer 12 is one, which is generally used for the driving of the discharge lamps of the kind, and in which a leakage inductance is about 0.1 to 30% of a primary inductance of the transformer 12. Here, the leakage inductance is defined as a primary inductance when the secondary coil is short-circuited.

On the other hand, the outer electrode fluorescent lamp 13 is connected between the terminals of the secondary coil L2 of the pulse transformer 12. A flicker preventing circuit 14 is connected in parallel between the terminals of the primary coil L1 of the pulse transformer 12. The flicker preventing circuit 14 is composed by a series connection of a third switching device S3 and a resistance element R, in which the third switching device S3 is switched ON and OFF by the third drive signal 11*c* provided from the drive signal circuit 10.

Figure 4:
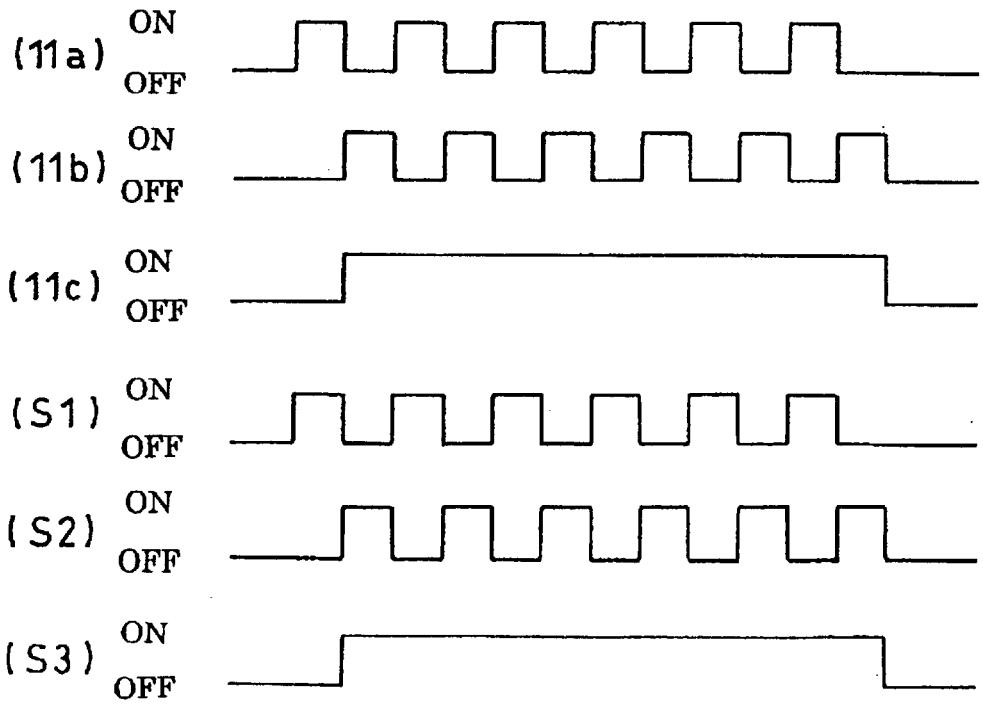
FIG. 4 is a timing chart of the pulse drive signal used in the discharge lamp drive device shown in FIG. 2.

Now, the operation of the discharge lamp drive device according to the present invention described above will be explained referring to FIG. 4. The drive signals 11*a*, 11*b* supplied from the driven signal circuit 11 shown in FIG. 2 and FIG. 3 are pulse signals the phases of which are inverted to each other as shown in (11*a*), (11*b*) in FIG. 4. Specifically, the drive signal 11*b* is in OFF state when the drive signal 11*a* is in ON state and, on the contrary, the drive signal 11*b* is in ON state when the drive signal 11*a* is in OFF state. The drive signal 11*a* turns the first switching device S1 ON while the drive signal 11*a* is ON, and turns the first switching device S1 OFF while the drive signal 11*a* is OFF, as shown in (S1) of FIG. 4. The drive signal 11*b* turns the second switching device S2 ON and OFF in a similar manner. Therefore, the first and the second switching devices S1, S2 are always driven by the drive signal 11*a*, 11*b* so that when one is ON, another is OFF.

While the first switching device S1 is ON and the second switching device S2 is OFF, the current flows in the circuit composed of the power source V—the first switching device S1—the third inductance element L3—the primary coil L1 of the pulse transformer 12—the capacitor C2, as indicated by an arrow A shown in FIG. 2, thereby charging the capacitor C2. Next, while the first switching device S1 is OFF and the second switching device S2 is ON, the current flows in the circuit composed of the power source V—the capacitor C1—the primary coil L1 of the pulse transformer 12—the diode D—the inductance element L4—the second switching device S2—the ground, as indicated by an arrow B shown in FIG. 3, through which an electric charge stored in the capacitor C2 is discharged to the ground at the same time. Here, the diode D cuts off the electric current flowing in the direction other than those indicated by the arrows A and B.

In this way, the pulsed current synchronized with the drive signal 11*a*, 11*b* is supplied from the power source V to the primary coil L1 of the pulse transformer 12 through the capacitor C2 which functions as a ballast element. The electric power thus induced and boosted in the voltage in the secondary coil is supplied into the fluorescent lamp. Here, the primary coil L1 of the pulse transformer 12 constructs an LC resonance circuit together with the capacitors C1, C2, supplying the output pulse generated in the secondary coil L2 to the outer electrode type fluorescent lamp 13.

The light control signal generating circuit 10 shown in FIG. 2 and FIG. 3 is controlled by the output signal 10*a*, 10*b*, . . . , 10*n* to vary the numbers of the output pulse per unit time supplied from the drive signal generating circuit 11. By this procedure, the light control signal generating circuit continuously adjusts the light control ratio in a range from 0 to 100%.

Figure 6:
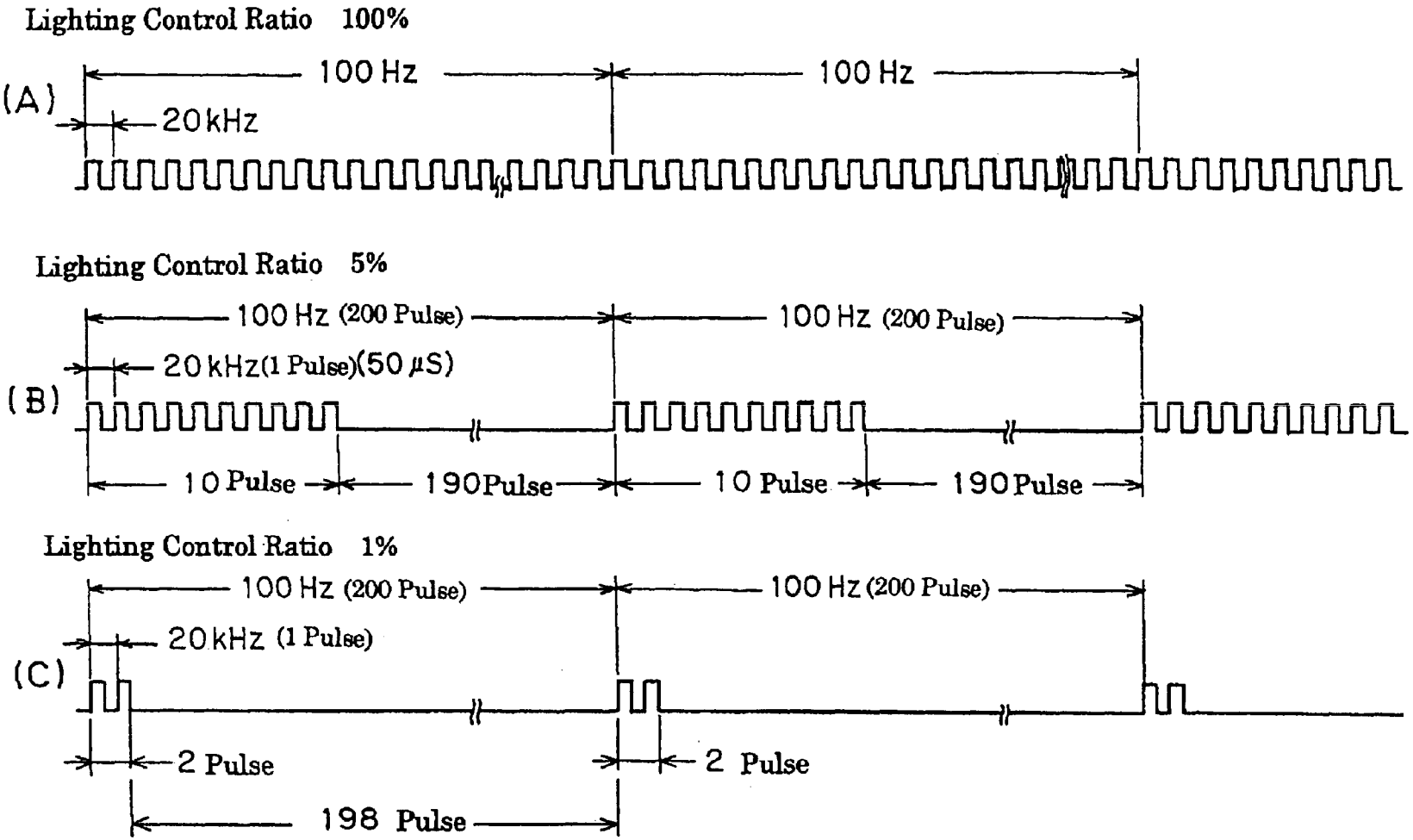
FIG. 6 shows a pulse wave form showing a relation between the output pulse of the drive signal generating circuit and the lighting control rate.

FIG. 6 shows a pulse wave form showing a relation between the output pulse of the drive signal generating circuit and the lighting control rate. FIG. 6 (A) is a wave form showing the drive signal 11*a* (or 11*b*) when the light control ratio is 100%. Assuming the repetition frequency of the drive signal 11*a* to be 20 kHz, for example, the repetition period is 50 $\mu$s. Now, setting the unit time as 0.01 s (repetition frequency of which is 100 Hz), the numbers of the output pulse of the drive signal generating circuit 11 per unit time is 200. That is, when the light control ratio is 100%, the drive signal 11*a* repeatedly provides 200 pulses per unit time with the repetition frequency of 100 Hz.

FIG. 6 (B) shows the wave form of the drive signal 11*a* (or 11*b*) when the light control ratio is 5%. The drive signal generating circuit 11 thus provides the output pulse signal of 10 pulses per unit time.

FIG. 6 (C) shows the wave form of the drive signal 11*a* (or 11*b*) when the light control ratio is 1%. The drive signal generating circuit 11 thus provides the output pulse signal of 1 pulse per unit time.

The output signal 10*a*, 10*b*, . . . , 10*n* of the light control signal generating circuit 10 form a n-digit binary signal, which expresses a lighting control ratio (%)ranging from 0 to 100. The drive signal generating circuit 11 counts the number of output pulse per unit time designated by the output signal 10*a*, 10*b*, . . . , 10*n* of the light control signal generating circuit 10 using a built-in microcomputer and supplies them as its output signal.

Figure 5:
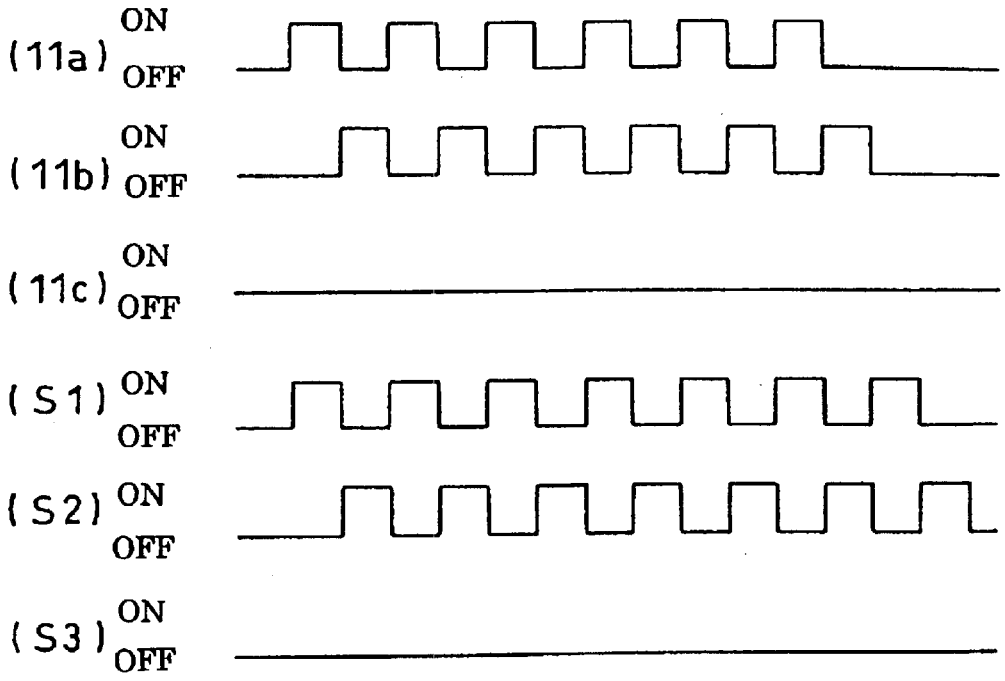
FIG. 5 is also a timing chart of the pulse drive signal used in the discharge lamp drive device shown in FIG. 2.

By the way, the third switching device S3 forming the flicker preventing circuit 14 shown in FIG. 2 and FIG. 3 is controlled to be turned ON and OFF by the third drive signal 11*c*, which is supplied from the drive signal circuit 10. The third signal 11*c* is a binary signal, which is turned ON and OFF at a far long repetition period compared with that of the first and the second pulse drive signal 11*a*, 11*b*, as shown by (11*c*) of FIG. 4 and FIG. 5. The third switching device S3 is controlled to be turned ON and OFF by the third drive signal 11*c* as shown by (S3) in FIG. 4 and FIG. 5. The third drive signal 11*c* is also controlled by the output signal 10*a*, 10*b*, . . . , 10*n* of the light control signal generating circuit 10. That is, the third drive signal 11*c* is so controlled as to be turned ON, when the light control ratio designated by the output signal 10*a*, 10*b*, . . . , 10*n*, is equal or lower than a prescribed value, for example, 20%. And the third drive signal 11*c* is so controlled as to be turned OFF when the light control ratio is equal or higher than 20%.

When the third switching device S3 is turned OFF, the flicker preventing circuit 14 is turned OFF as shown in FIG. 2 and FIG. 3, and the LC resonant circuit composed of the primary coil L1 of the pulse transformer 12 and the capacitor C1, C2, resonates with a resonance frequency f which is given by the following equation.

$$f=1/(2\pi\sqrt{LC})$$

Next, when the third switching device S3 of the flicker preventing circuit 14 is ON, the resistance element R is connected in parallel with the primary coil L1 of the pulse transformer 12. The resistance element R functions to dump the resonance in the LC resonance circuit composed of the primary coil L1 and the capacitor C1, C2, as a so to speak dumping resistance. Thus, the ringing generated in the LC resonance circuit is prevented. As a result, the ringing in lamp voltage and lamp current generated between the electrodes of the outer electrode type fluorescent lamp 13 also can be prevented or suppressed.

Figure 7:
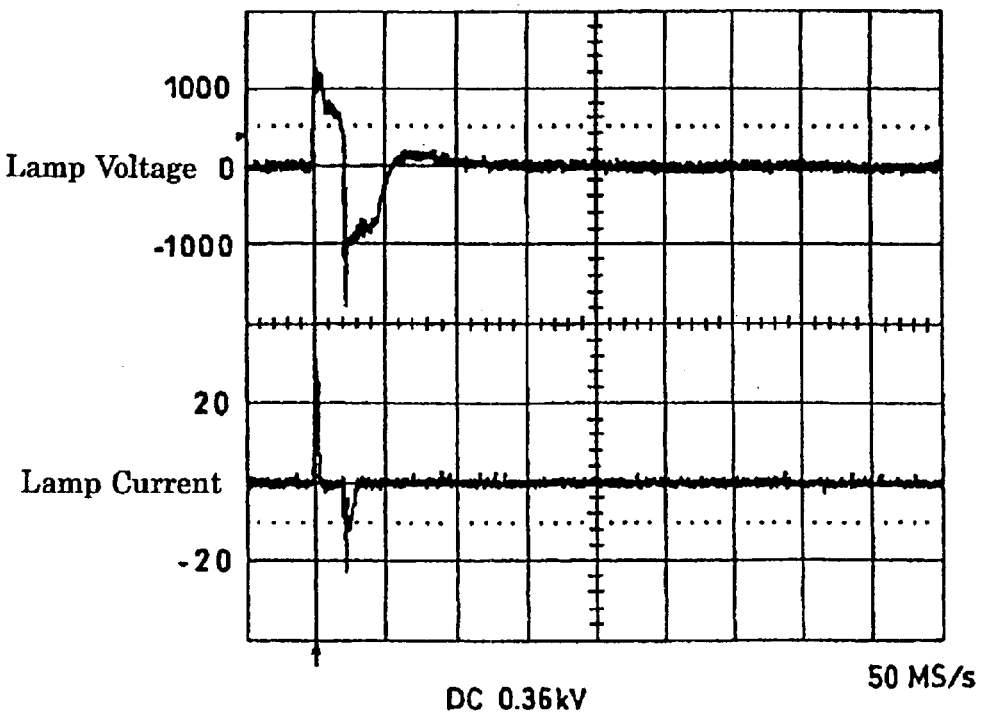
FIG. 7 shows wave forms showing a lamp voltage and a lamp current applied to the fluorescent lamp shown in FIG. 1 by the discharge lamp drive device shown in FIG. 2 and FIG. 3.
Figure 8:
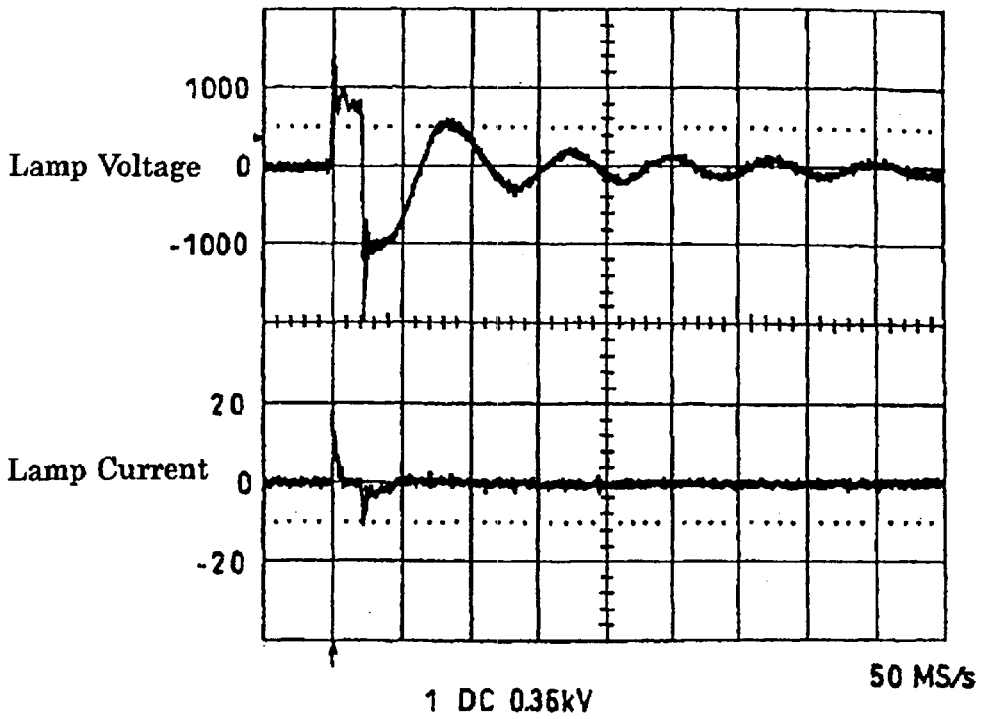
FIG. 8 shows wave forms showing the lamp voltage and the lamp current applied to the fluorescent lamp shown in FIG. 1 by the conventional discharge lamp drive device for comparison.

FIG. 7 shows wave forms showing a lamp voltage and a lamp current generated between the electrodes of the outer electrode type fluorescent lamp 13 connected with the secondary coil L2 of the pulse transformer 12, while FIG. 8 shows, for the comparison, the wave form of the lamp voltage and the lamp current when the third switching device S3 of the flicker prevention circuit 14 is turned OFF.

Figure 9:
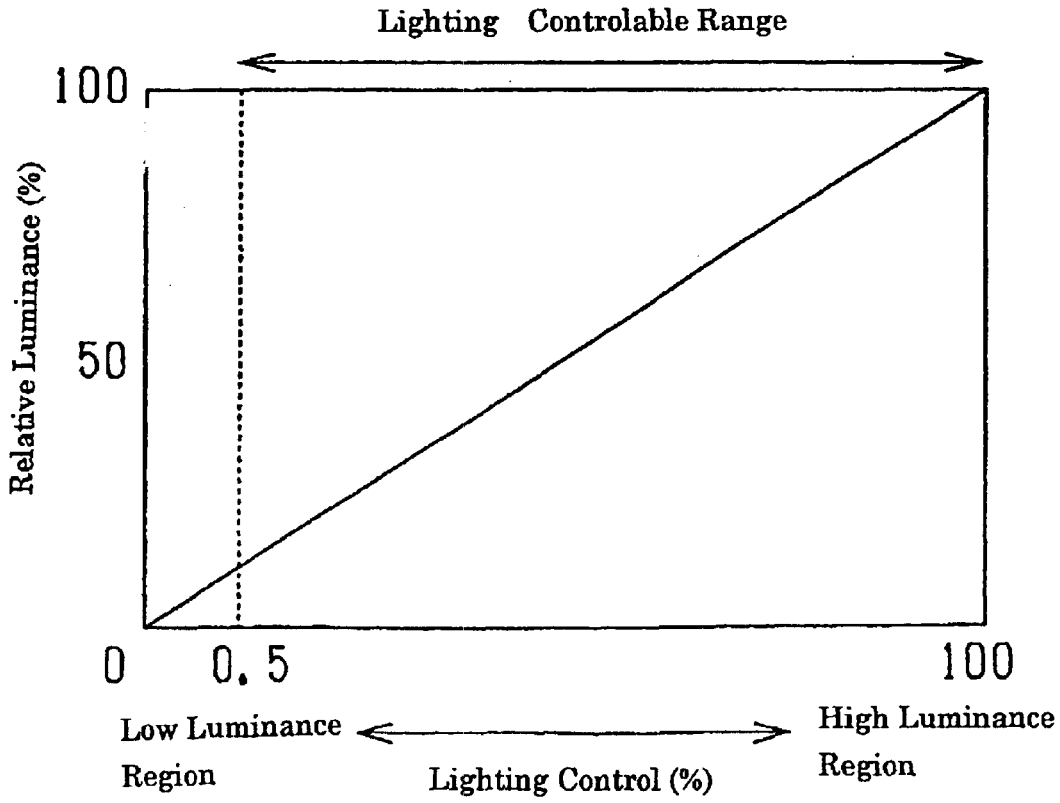
FIG. 9 is a graph showing light control characteristics of the fluorescent lamp shown in FIG. 2 and FIG. 3.

As shown in these figures, the ringing in the lamp voltage wave form, which is observed in the conventional drive circuit, is greatly decreased by using the drive circuit according to the present invention. As a result, the luminance of the outer electrode type fluorescent lamp 13 became stable even when the light control ratio is equal or less than 20%, thereby preventing the flicker. In the embodiment described above, a stable and flicker less lighting has been realized until the light control ratio reaches the minimum ratio of 0.5% as shown in FIG. 9. FIG. 9 is a graph showing the light control characteristics of the fluorescent lamp driven by the discharge lamp drive device shown in FIG. 2 and FIG. 3, in which the abscissa indicates the light control ratio (%) and the ordinate indicates the relative luminance (%).

In the discharge lamp drive device described above, the elements L3, L4 having a resistance component are connected in series with the first and the second switching devices S1, S2, and uni-directional device D, which allows the electric current to flow in one direction is connected in series with one of the element L4 having a resistance component at the same time. With this arrangement, pause periods are formed at the time following the positive and negative peak in the lamp current as shown in FIG. 7, which enable to decrease the loss and to improve the efficiency in the drive circuit. Thus, the brightness at the center portion of the fluorescent lamp 13 can be increased by more than 10% compared with that is used in the conventional lamp drive device. However, even when the devices L3, L4 having a resistance component are omitted, the flicker was not observed in the outer electrode type fluorescent lamp with the improved luminance.

Figure 10:
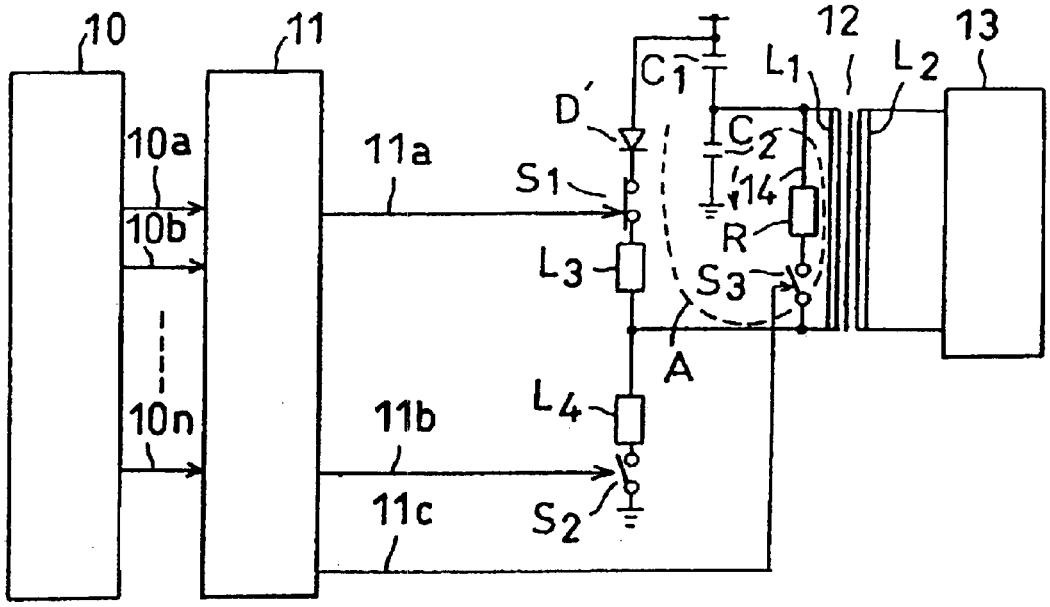
FIG. 10 is a block diagram showing another embodiment according to the present invention and its operation.
Figure 11:
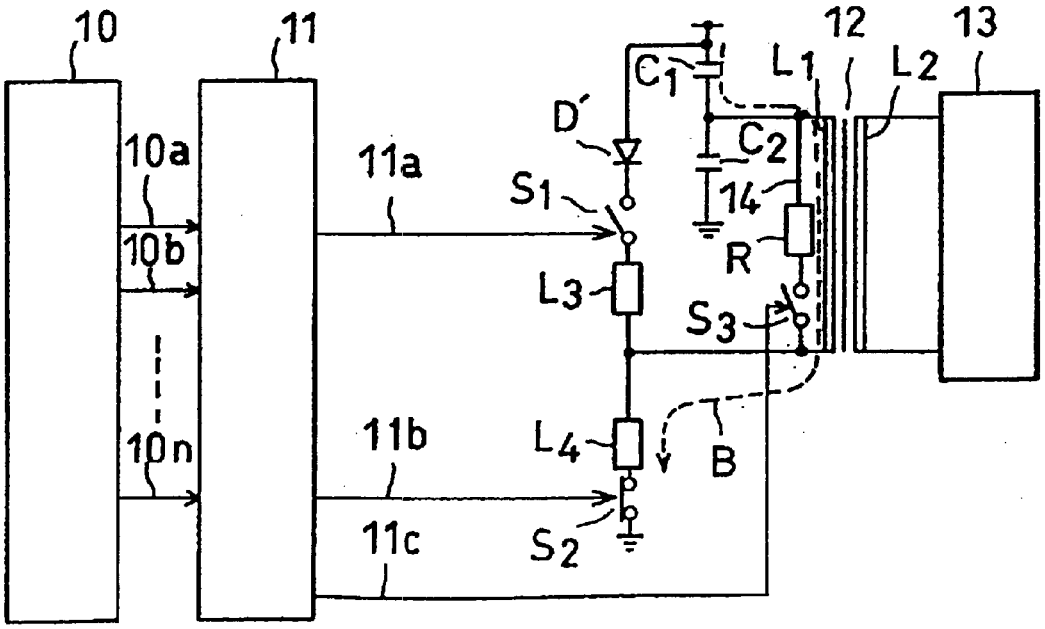
FIG. 11 is also a block diagram showing other embodiment according to the present invention and its operation.

FIG. 10 and FIG. 11 are block diagrams of a discharge drive device according to another embodiment of the present invention. This embodiment has a similar configuration to that of the embodiment shown in FIG. 2 and FIG. 3. Therefore, the same components are assigned with the same symbols thereby omitting detailed explanations, and only different parts are explained below. In this embodiment, a uni-directional device D' is connected in series with and between the first switching device S1 and the capacitor C1. With this arrangement, the luminance of the fluorescent lamp 13 was increased with the decrease in power loss and the efficiency of the drive circuit was improved as in the embodiment described above.

In this embodiment, the flicker of the fluorescent lamp at low light control ratio can be prevented by the function of the third switching device S3 of being turned ON and OFF in the flicker preventing circuit 14 as in the first embodiment.

Figure 12:
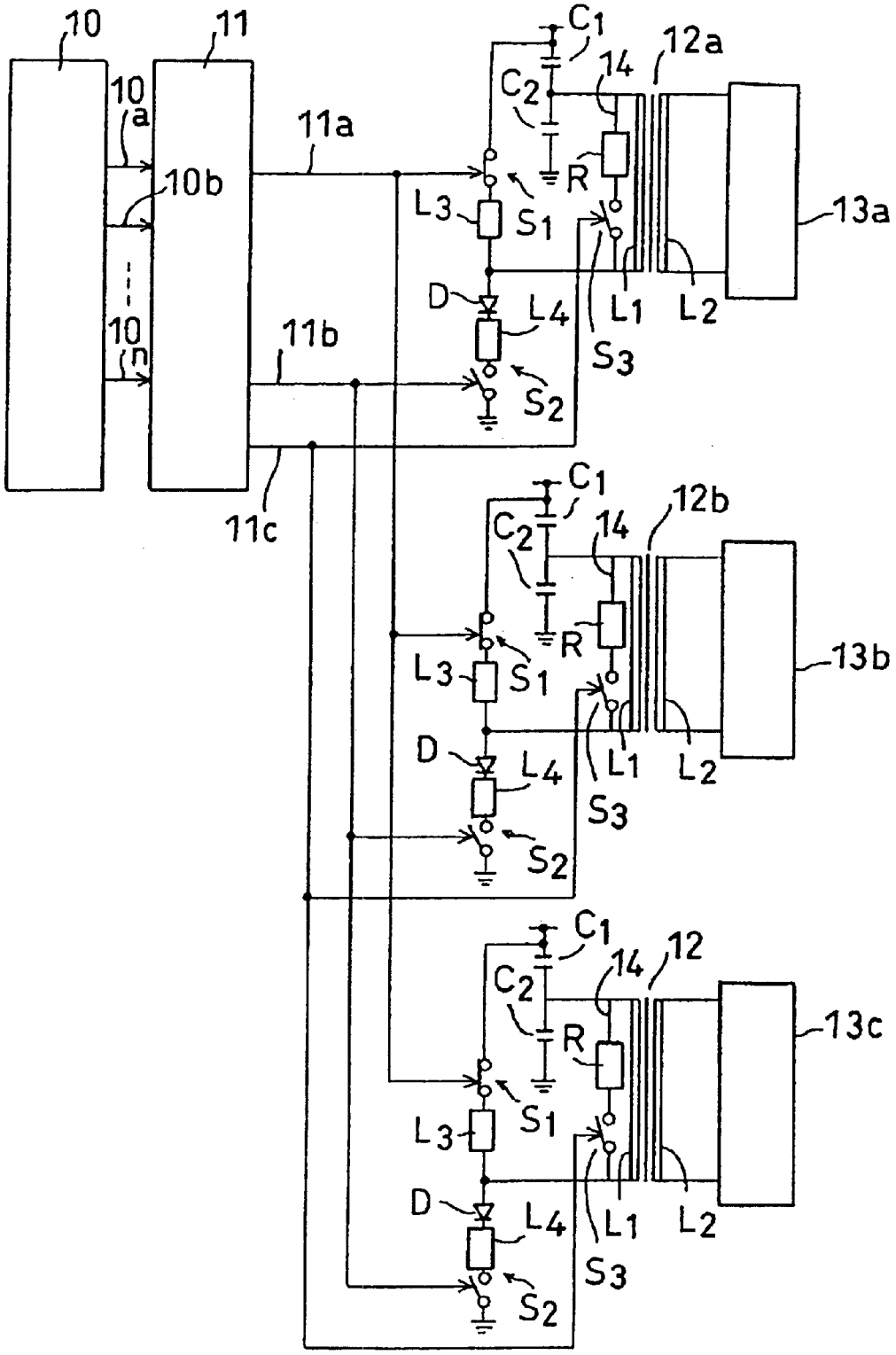
FIG. 12 is a block diagram showing yet other embodiment according to the present invention.

FIG. 12 is a block diagram showing yet other embodiment according to the present invention. In this embodiment, pulse drive signals 11*a*, 11*b* from common drive signal circuit 10 are supplied to a plurality of pulse transformers, for example, to three pulse transformers 12*a*, 12*b*, 12*c* in parallel. The configuration of the embodiment except for the above portion is fundamentally the same as that of the embodiment already described above. Thus, the same components are assigned with the same symbols omitting detailed explanation thereof an d only differing parts are explained below.

Three outer electrode type fluorescent lamps 13*a*, 13*b*, 13*c* are connected at the secondary coil L2 of three pulse transformers 12*a*, 12*b*, 12*c* respectively. The circuit configuration including the first switching device S1, the second switching device S2, the capacitor C1, C2, the diode D, and flicker preventing circuit 14 connected with the primary coil L1 of each pulse transformers 12*a*, 12*b*, 12*c* is similar to the circuit configuration shown in FIG. 2 and FIG. 3.

The pulse drive signals 11*a*, 11*b* of the drive signal circuit are supplied to the first switching device S1 and the second switching device S2 of each pulse transformer 12*a*, 12*b*, 12*c* respectively, and so control them as to alternately turn ON and OFF. Further, the third pulse drive signal 11*c* of the drive signal circuit 11 is supplied to the first switching device S3 of each pulse transformer 12*a*, 12*b*, 12*c* and so control them as to turn ON and OFF by the drive signal 11*c* from the light control signal generating circuit 10. Here in this case, the drive signal 11*a*, 11*b* can distribute the current among the pulse transformer 12*a*, 12*b*, 12*c* and reduce the load of the power source by shifting the phase of the each pulse signals supplied to each pulse transformer 12*a*, 12*b*, 12*c* by the amount from about 1 to 20 $\mu$s.

According to the present embodiment, the pulse drive signals 11*a*, 11*b*, which are supplied from the drive signal circuit 11 are divided and supplied to a plurality of fluorescent lamps 13*a*, 13*b*, and 13*c* for simultaneous operation. In the discharge lamp drive device according to the present embodiment, each of outer electrode type fluorescent lamp 13*a*, 13*b*, 13*c* are supplied with an input current having a required input voltage and current wave form at the same timing. That is, each unit including each pulse transformer 12*a*, 12*b*, 12*c* and outer electrode type fluorescent lamp 13*a*, 13*b*, 13*c* which are arranged in parallel or in a plane is operating simultaneously and in a similar manner. Thus, each unit operates basically in the similar manner to the circuit configurations shown in FIG. 1 and FIG. 2 with the similar advantages.

In the above description on each discharge lamp drive device, the explanation was made about the configuration, in which elements L3 and L4 having resistance component are connected in series with the first and the second switching devices S1, S2, and the uni-directional device D, which allows the electric current to flow in one direction is connected in series to one of the elements L4 having resistance component. Although the series connection of the elements L3 and L4 having resistance component are omitted, however, neither the flicker nor the ringing is generated (which means the decrease of the power loss or consumption). Thus, it is observed that a fine light control is possible with increased luminance.

The present invention is not limited to the above embodiments, but many variations can be adopted within the scope of the invention. For example, the number of the fluorescent lamp may be one or more.

Further, unidirectional devices D or D' may be connected in series to each of the first and the second switching devices S1, S2 respectively.

According to the present invention explained above, the circuit configuration is adopted, in which the flicker or ringing in the lamp current supplied to the fluorescent lamp is not occurred when the outer electrode type fluorescent lamp is driven for being lighted by pulse drive signals. With the circuit configuration, a fine light control is possible and the light emitting luminance of the fluorescent lamp can be improved by more than 10% compared with the luminance of the lamp when conventional circuit arrangement is used.

Here, the prevention of flicker and the possibility of a fine light control contribute to provide high picture quality of liquid crystal display units. Moreover, the increase of luminance enabled the decrease in the lamp current and the power consumption.

What is claimed is:

1. A discharge lamp device comprising:

a light control signal generating circuit;

a drive signal circuit which generates a first, a second and a third pulse drive signals;

each of said first and second pulse drive signals having a phase, which is inverted to each other;

said third pulse drive signal being ON and OFF state in accordance with an output signal of said light control signal generating circuit;

a first and a second switching devices which are controlled to be turned ON and OFF alternately by said first and second pulse drive signal supplied by said drive signal circuit;

a pulse transformer which is provided with a primary and a secondary coils;

a direction of an electric current flowing in said primary coil being switched by said first and second switching devices and a boosted pulse voltage being generated in said secondary coil;

a flicker preventing circuit which is connected in parallel with the primary coil of said pulse transformer;

said flicker preventing circuit being composed of a series connected circuit of an element having a resistance component and a third switching device, which is turned ON and OFF in accordance with said third drive signal supplied by said drive signal circuit; and an outer electrode fluorescent lamp connected with said secondary coil of said pulse transformer.

2. A discharge lamp device according to claim 1, wherein said first and second switching devices are connected in series between said power source and the ground, the primary coil of said pulse transformer is connected with the connecting point of said power source and said first and second switching devices, and a capacitor is connected between said power source and the ground.

3. A discharge lamp device according to claim 2, wherein the third drive signal which is supplied by said drive signal circuit so controls as to turn said third switching device ON when the light control ratio designated by the output signal of said light control signal generating circuit is equal to or lower than the predetermined value, and so controls as to turn said third switching device OFF when the light control ratio designated by the output signal of said light control signal generating circuit is equal to or higher than the predetermined value.

4. A discharge lamp device according to claim 3, wherein the predetermined value of said light control ratio is about 20%.

5. A discharge lamp device according to claim 4, wherein at least one of said the first and the second switching device is connected with a one direction device which allows the electric current to flow only in one direction.

6. A discharge lamp device according to claim 1, wherein said outer electrode type fluorescent lamp is composed of a glass tube on an inner surface of which a phosphor film is formed and a rare gas composed mainly of xenon is enclosed airtight therein, an inner electrode which is provided at one end of said glass tube, said inner electrode having a lead terminal led out of said glass tube, and an outer electrode which is wound spirally around said glass tube along almost the entire length of said tube at a predetermined pitch.

7. A discharge lamp device according to claim 1, wherein a plurality of sets each including die first and second switching devices, the pulse transformer, the flicker preventing circuit including the third switching device, and the outer electrode type fluorescent lamp are provided, wherein the first and the second pulse-driving signal of the drive signal circuit are supplied in parallel to the first and said second switching devices of each of the plurality of sets, and wherein the third pulse-driving signal of the driving signal circuit is supplied in parallel to the third switching device of each of the plurality of sets.

8. A display lamp drive device comprising:

a light control signal generating circuit;

a drive signal circuit which generates a first, a second and a third pulse drive signals;

each of said first and second pulse drive signals having an phase, which is inverted to each other;

said third pulse drive signal being ON and OFF state in according with an output signal of said light control signal generating circuit;

a first and a second switching devices which are controlled to be turned ON and OFF alternately by said first and second pulse drive signal supplied by said drive signal circuit;

a pulse transformer which is provided with a primary and a secondary coils;

a direction of an electric current flowing in said primary coil being switched by said first and second switching devices and a boosted pulse voltage being generated in said secondary coil; and a flicker preventing circuit which is connected in parallel with the primary coil of said pulse transformer;

said flicker preventing circuit being composed of a series connected circuit of an element having a resistance component and a third switching device, which is turned ON and OFF in accordance with said third drive signal supplied by said drive signal circuit.

9. A discharge lamp drive device according to claim 8, wherein said first and second switching devices are connected in series between said power source and the ground, the primary coil of said pulse transformer is connected with the connecting point of said power source and said first and second switching devices, and a capacitor is connected between said power source and the ground.

10. A discharge lamp drive device according to claim 9, wherein the third drive signal which is supplied by said drive signal circuit so controls as to turn said third switching device ON when the light control ratio designated by the output signal of said light control signal generating circuit is equal to or lower than the predetermined value, and so controls as to turn said third switching device OFF when the light control ratio designated by the output signal of said light control signal generating circuit is equal to or higher than the predetermined value.

11. A discharge lamp drive device according to claim 10, wherein the predetermined value of said light control is 20%.

12. A discharge lamp drive device according to claim 11, wherein at least one of said the first and the second switching device is connected with a one direction device which allows the electric current to flow only in one direction.

13. A discharge lamp drive device according to claim 8, wherein a plurality of sets each including the first and second switching devices, the pulse transformer, the flicker preventing circuit including the third switching device, and the outer electrode type fluorescent lamp are provided, wherein the first and the and the second pulse-driving signal of the drive signal circuit are supplied in parallel to the first and said second switching devices of each of the plurality of sets, and wherein the third pulse-driving signal of the driving signal circuit is supplied in parallel to the third switching device of each of the plurality of sets.

14. A discharge lamp device according to claim 2, wherein said outer electrode type fluorescent lamp is composed of a glass tube on an inner surface of which a phosphor film is formed and a rare gas composed mainly of xenon is enclosed airtight therein, an inner electrode which is provided at one end of said glass tube, said inner electrode having a lead terminal led out of said glass tube, and an outer electrode which is wound spirally around said glass; tube along almost the entire length of said tube at a predetermined pitch.

15. A discharge lamp device according to claim 3, wherein said outer electrode type fluorescent lamp is composed of a glass tube on an inner surface of which a phosphor film is formed and a rare gas composed mainly of xenon is enclosed airtight therein, an inner electrode which is provided at one end of said glass tube, said inner electrode having a lead terminal led out of said glass tube, and an outer electrode which is wound spirally around said glass tube along almost the entire length of said tube at a predetermined pitch.

16. A discharge lamp device according to claim 4, wherein said outer electrode type fluorescent lamp is composed of a glass tube on an inner surface of which a phosphor film is formed and a rare gas composed mainly of xenon is enclosed airtight therein, an inner electrode which is provided at one end of said glass tube, said inner electrode having a lead terminal led out or said glass tube, and an outer electrode which is wound spirally around said glass tube along almost the entire length or said tube at a predetermined pitch.

17. A discharge lamp device according to claim 2, wherein a plurality of sets each including the first and second switching devices, the pulse transformer, the flicker preventing circuit including the third switching device, and the outer electrode type fluorescent lamp are provided, wherein the first and the second pulse-driving signal of the drive signal circuit are supplied in parallel to the first and said second switching devices of each of the plurality of sets, and wherein the third pulse-driving signal of the driving signal circuit is supplied in parallel to the third switching device of each of the plurality of sets.

18. A discharge lamp device according to claim 3, wherein a plurality of sets each including the first and second switching devices, the pulse transformer, the flicker preventing circuit including the third switching device, and the outer electrode type fluorescent lamp are provided, wherein the first and the second pulse-driving signal of the drive signal circuit are supplied in parallel to the first and said second switching devices of each of the plurality of sets, and wherein the third pulse-driving signal of the driving signal circuit is supplied in parallel to the third switching device of each of the plurality of sets.

19. A discharge lamp drive device according to claim 9, wherein a plurality of sets each including the first and second switching devices, the pulse transformer, the flicker preventing circuit including the third switching device, and the outer electrode type fluorescent lamp are provided, wherein the first and the second pulse-driving signal of the drive signal circuit are supplied in parallel to the first and said second switching devices of each of the plurality of sets, and wherein the third pulse-driving signal of the driving signal circuit is supplied in parallel to the third switching device of each of the plurality of sets.

20. A discharge lamp drive device according to claim 10, wherein a plurality of sets each including the first and second switching devices, the pulse transformer, the flicker preventing circuit including the third switching device, and the outer electrode type fluorescent lamp are provided, wherein the first and the second pulse-driving signal of the drive signal circuit are supplied in parallel to the first and said second switching devices of each of the plurality of sets, and wherein the third pulse-driving signal of the driving signal circuit is supplied in parallel to the third switching device of each of the plurality of sets.

21. A discharge lamp drive device according to claim 11, wherein a plurality of sats each including the first and second switching devices, the pulse transformer, the flicker preventing circuit including the third switching device, and the outer electrode type fluorescent lamp are provided, wherein the first and the second pulse-driving signal of the drive signal circuit are supplied in parallel to the first and said second switching devices of each of the plurality of sets, and wherein the third pulse-driving signal of the driving signal circuit is supplied in parallel to the third switching device of each of the plurality of sets.

* * * * *

UNITED STATES PATENT AND TRADEMARK OFFICE

CERTIFICATE OF CORRECTION

PATENT NO. : 6,774,579 B2
DATED : August 10, 2004
INVENTOR(S) : Eiji Abe

It is certified that error appears in the above-identified patent and that said Letters Patent is hereby corrected as shown below:

Title page,
Item [54], Title, replace "ELECTRIC DISCHARGE LAMP AND ELECTRIC DISCHARGE LAMP DRIVE APPARATUS" with -- DISCHARGE LAMP DEVICE AND DISCHARGE LAMP DRIVE DEVICE --

Column 10,
Line 38, replace "die" with -- the --

Column 11,
Line 50, replace "glass;" with -- glass --

Column 12,
Line 52, replace "sats" with -- sets --

Signed and Sealed this

Seventh Day of June, 2005

JON W. DUDAS
*Director of the United States Patent and Trademark Office*